United States Patent [19]

Becka

[11] 4,391,012

[45] Jul. 5, 1983

[54] SWINGABLE INSOLE REST

[75] Inventor: Michael M. Becka, Nashua, N.H.

[73] Assignee: International Shoe Machine Corporation, Nashua, N.H.

[21] Appl. No.: 269,447

[22] Filed: Jun. 2, 1981

[51] Int. Cl.[3] ..... A43D 21/00; A43D 3/00

[52] U.S. Cl. ..... 12/10.5; 12/123

[58] Field of Search ..... 12/10.1, 10.5, 8.5, 12/8.8, 14.2, 14.5, 123, 142 R; 118/411

[56] References Cited

U.S. PATENT DOCUMENTS

| | | | |
|---|---|---|---|
| 3,099,846 | 8/1963 | Lane et al. | 12/10.1 |
| 3,157,897 | 11/1964 | Morrill | 12/10.5 |
| 3,852,841 | 12/1974 | Schindler et al. | 12/10.5 |
| 3,885,263 | 5/1975 | Gagnon | 12/142 R |
| 3,902,211 | 9/1975 | Lindsey | 12/14.5 |
| 4,173,050 | 11/1979 | Vornberger | 12/14.5 |
| 4,227,483 | 10/1980 | Becka | 118/411 |

*Primary Examiner*—Patrick D. Lawson

[57] ABSTRACT

An insole rest (14) that supports a shoe assembly (64) formed of a last (66) having an upper (70) draped thereon and an insole (68) located on its bottom. A first motor (36) is so connected to the insole rest as to effect heightwise movement of the insole rest and a second motor (38) is so connected to the insole rest as to effect swinging movement of the insole rest.

4 Claims, 5 Drawing Figures

SWINGABLE INSOLE REST

BACKGROUND AND DESCRIPTION OF THE INVENTION

U.S. Pat. Nos. 3,902,211 and 4,227,483 are typical of prior art references showing machines, operable on a shoe assembly formed of a last having an upper draped thereon and an insole located on its bottom, for stretching the vamp of the upper about the last and wiping the vamp of the upper margin against the insole. In these prior art machines, there are provided: an insole rest mounted for heightwise movement between a lower position and an upper position; a plurality of pincers extending about the insole rest, each pincers having a pair of jaws movable between open and closed positions; wiping means, mounted for forward and inward movement, extending outwardly about the insole rest; means for initially maintaining the insole rest in its lower position wherein the top of the insole rest is below the level of the wiping means with the shoe assembly so supported on the insole rest that the toe end of the shoe assembly faces rearwardly; means for initially maintaining all of the pincers jaws in their open positions; means for thereafter causing all of the pincers jaws to move to their closed positions to thereby grip the vamp of the upper margin; means for thereafter effecting rising movement of the insole rest to its upper position wherein the top of the insole rest is substantially at the level of the top of the wiping means to thereby enable the vamp of the upper to be stretched about the vamp of the last; means for thereafter imparting forward and inward movement, in a wiping stroke, to the wiping means to cause the wiping means to wipe the vamp of the upper margin against the insole; and means for causing all of the pincers jaws to move to their open positions and release the gripped vamp of the upper margin prior to the completion of the wiping stroke.

It is desirable that, at the completion of the rise of the insole rest, the bottom of the insole that is supported by the insole rest be substantially at the level of the top of the wiping means in order for the wiping means to effectively perform its wiping function. Therefore, at this time, the top of the insole rest should be substantially parallel to the top of the wiping means. In the prior art machine, the insole rest is movable at right angles to the direction of movement of the wiping means during the wiping stroke so that in the lower position of the insole rest the top of the insole rest and the bottom of the insole are substantially parallel to the tops of the wiping means.

It has been found that, with this arrangement of the insole rest when in its lower position, difficulties have arisen in placing portions of the margin of the vamp of the upper between certain of the pincers jaws because of the narrowness of certain portions of the upper margin. This problem is particularly troublesome in connection with the placement of the ball portions of the upper margin between the jaws of ball pincers which are furthermost from the toe end of the shoe assembly. In accordance with this invention, this difficulty is overcome by providing in the machine: means mounting the insole rest for heightwise swinging movement, about a prone axis that is located rearwardly of the insole rest, between an inclined position wherein the insole rest top is inclined rearwardly and upwardly and a prone position wherein the insole rest top is substantially parallel to the top of the wiping means; means for initially maintaining the insole rest in its inclined position when the insole rest is in its lower position; and means to effect such swinging movement to the insole rest about said axis that the insole rest is in its prone position when the insole rest is in its upper position. With this arrangement, the placement of the shoe assembly on the insole rest, while the insole rest is in its inclined position, enables all of the margin of the vamp of the upper to be readily placed between all of the pincers jaws and the insole rest top is still substantially parallel to the top of the wiping means at the completion of the rise of the insole rest.

DESCRIPTION OF THE PREFERRED EMBODIMENT

Figure 1:
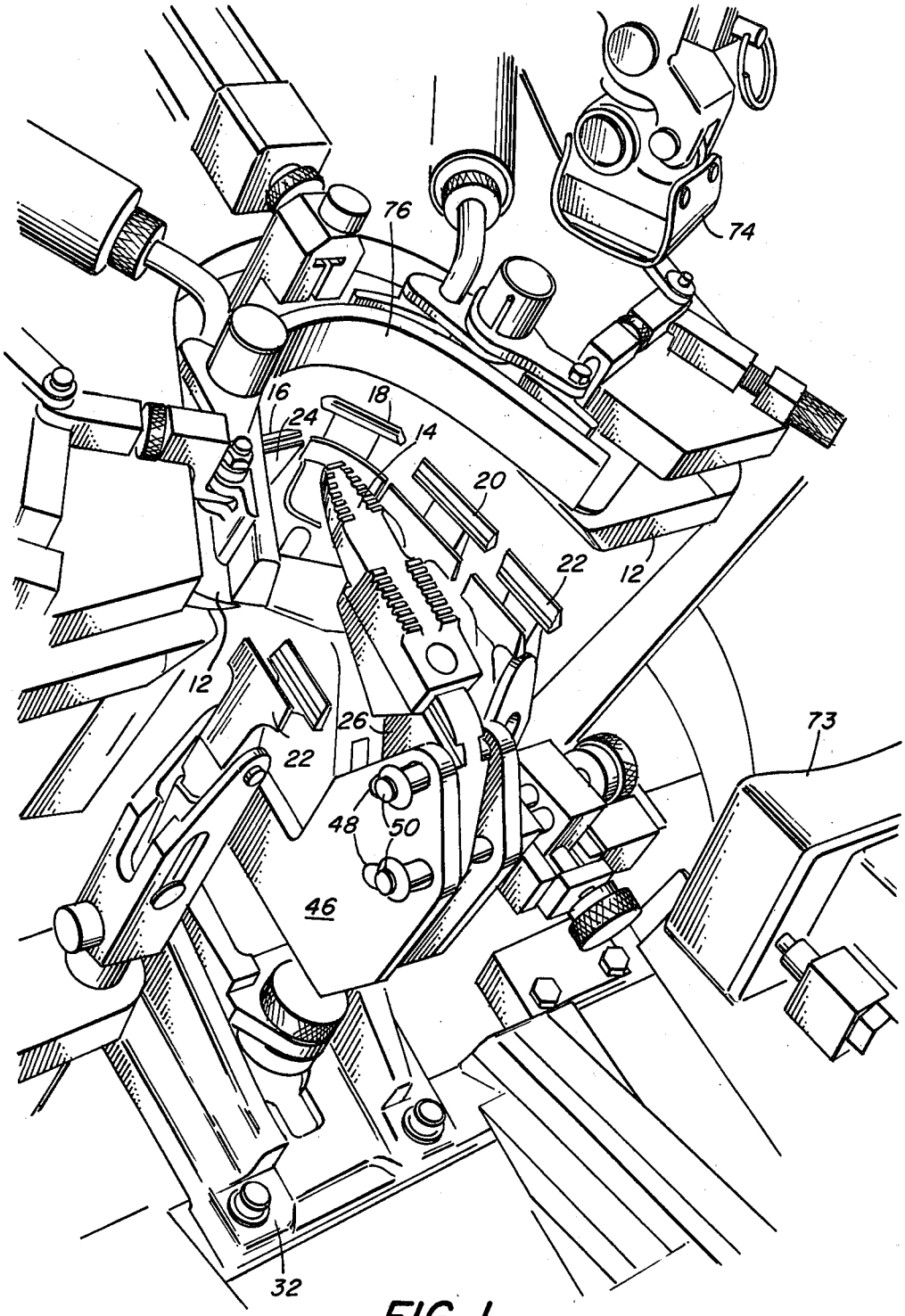
FIG. 1 is an isometric view of a part of the machine.
Figure 2:
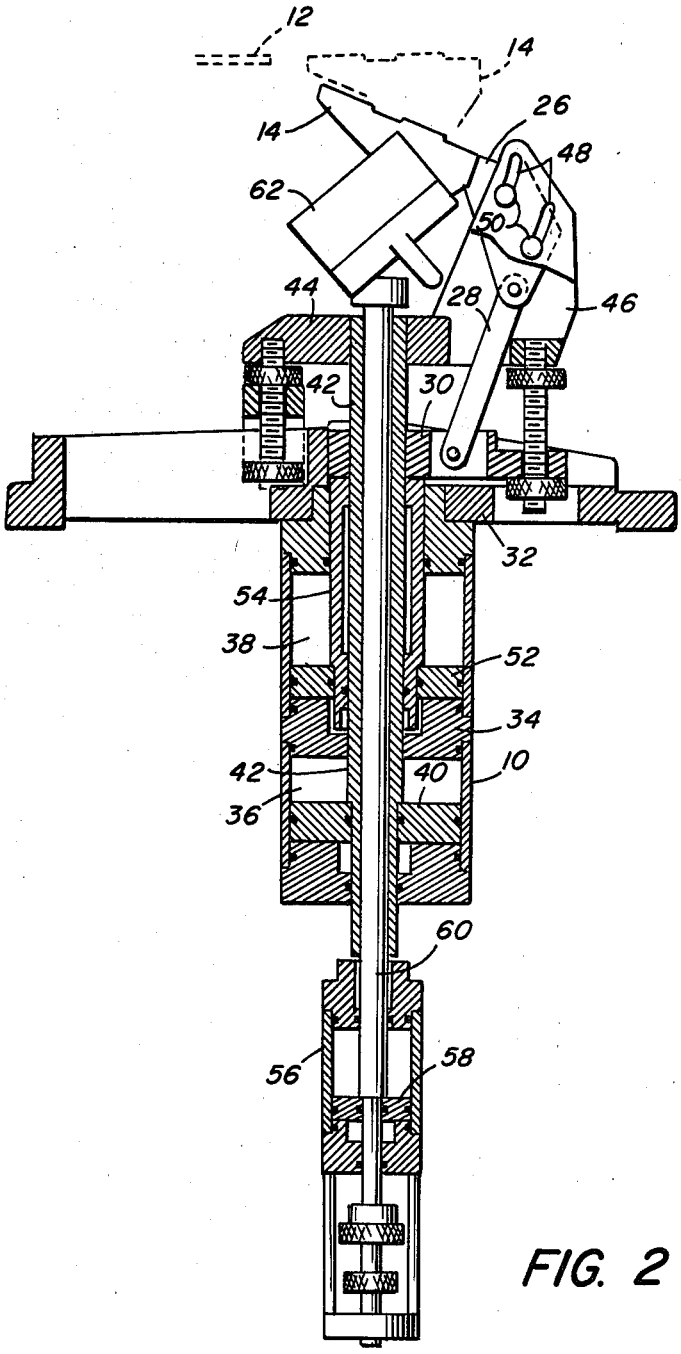
FIG. 2 is a section of the mechanism for effecting the rising and swinging movements of the insole rest.

The operator is intended to stand facing the machine looking upwardly from the bottom of FIG. 1 and looking leftwardly in FIG. 2. Machine parts closest to the operator are considered to be at the front of the machine and machine parts furthermost from the operator are considered to be at the back of the machine. Parts moving towards the operator are considered to have "forward" movement and parts moving away from the operator are considered to have "rearward" movement.

The machine is inclined for ease of presentation of shoe assemblies thereto. However, for ease of explanation, the axis of the cylinder 10 (FIG. 2) will be considered to be vertical and the tops of wipers 12 (FIG. 1) will be considered to lie in a horizontal plane.

Referring to FIG. 1, the machine includes an insole rest 14. A toe pincers 16 is located rearwardly of the insole rest 14 and side pincers 18 and 20 are located on each side of the insole rest 10 forwardly of and on each side of the toe pincers 16. Only one of each of the pincers 18 and 20 is shown in FIG. 1, the other pincers 18 and 20 being hidden by machine parts. The side pincers 18 which are the rearmost side pincers closest to the toe pincers 16 are corner pincers. The side pincers 20 which are forward of the corner pincers 18 are forepart pincers. Ball pincers 22 are located on each side of the insole rest 14 and forwardly of the forepart pincers 20.

Figure 3:
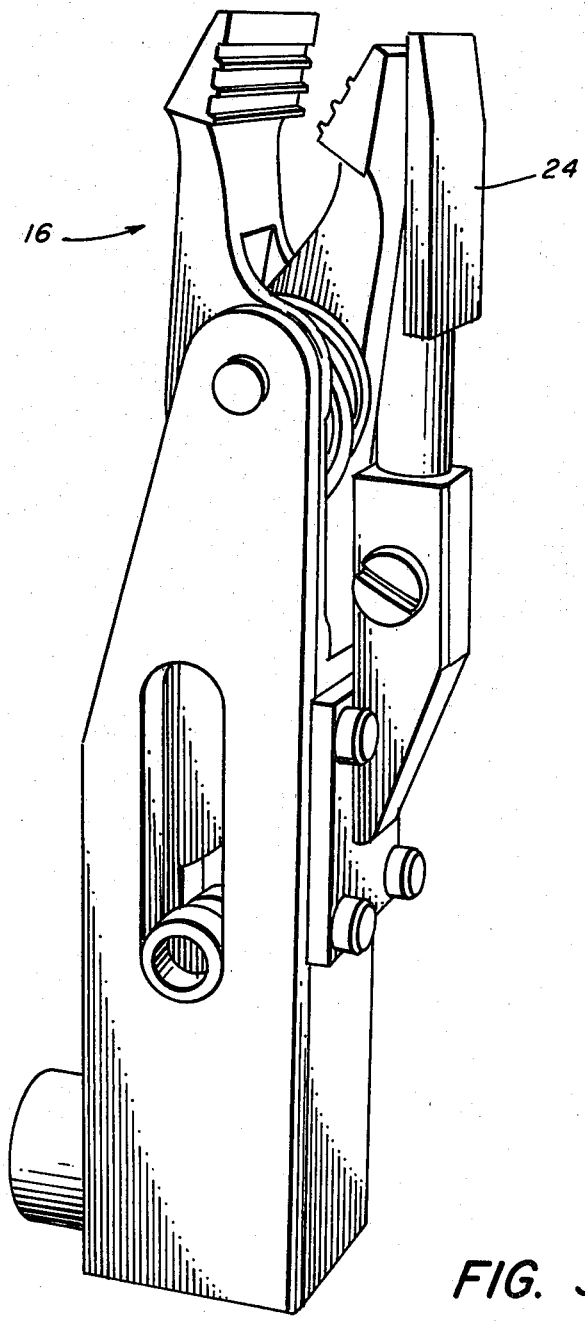
FIG. 3 is an isometric view of a toe pincers having a toe bar mounted thereto.

The pincers 16, 18, 20 and 22, which are mounted to the machine in any desired manner known to the prior art such as that shown in U.S. Pat. Nos. 3,902,211 or 4,173,050, each comprises a pair of jaws which are relatively movable between an open position wherein the jaws are spaced from each other and a closed position wherein the jaws bear against each other to grip an object located between the jaws. Any desired mechanism known to the prior art, such as that shown in U.S. Pat. No. 3,902,211, may be utilized to move the pincers jaws between their open and closed positions. As shown in FIG. 3, a toe bar 24 is mounted on the front of the toe pincers 16.

Referring to FIG. 2, the insole rest 14 is secured to a bracket 26 that is pivoted to the top of a link 28. The bottom of the link 28 is pivoted to a plate 30. The cylinder 10, which is fixedly mounted in the machine, is secured at its top to a base 32 that underlies the plate 30. A wall 34 of the cylinder 10 divides the cylinder 10 with a lower pneumatic motor 36 and an upper pneumatic motor 38. The piston 40 of the motor 36 is connected to a hallow piston rod 42 whereby heightwise movement of the piston 40 in response to actuation of the motor 36 effects heightwise movement of the piston rod 42 in the cylinder 10. The top of the piston rod 42 is secured to a plate 44. An upright 46 is secured to and extends upwardly of the plate 44. Curved slots 48 in the upright 46 receive headed pins 50 in the bracket 26 to enable the bracket 26 and the insole rest 14 to tilt heightwise about the center of curvature of the slots 48, the slots 48 having a common center of curvature as described below. The piston 52 of the motor 38 is connected to a hollow piston rod 54 that encompasses and is slidable on the piston rod 42 whereby heightwise movement of the piston rod 54 in response to actuation of the motor 38 effects heightwise movement of the piston rod 54 in the cylinder 10. The top of the piston rod 54 is rigidly secured to the plate 30 with the plate 30 encompassing and being slidable on the piston rod 42. The motors 36 and 38 are so constructed that the piston 52 has a greater range of heightwise movement in the motor 38 than the range of heightwise movement of the piston 40 in the motor 36.

The bottom of the piston rod 42 is secured to a pneumatic motor 56 operative to move its piston 58 heightwise. The piston 58 is secured to a piston rod 60 that is encompassed by and slidable within the piston rod 42. The top of the piston rod 60 is secured to an adhesive applicator 62 that is mounted and constructed similarly to the adhesive applicator 12 of U.S. Pat. No. 4,227,483.

In the idle condition of the machine: the jaws of the pincers 16, 18, 20 and 22 are in their open positions; the piston rod 40 is in a lowered position in the motor 36 and the piston rod 52 is in a lowered position in the motor 38 so that the top of the insole rest 14 is inclined upwardly and rearwardly as shown in solid lines in FIG. 2; and the piston rod 58 is in a lowered position in the motor 56 so that the adhesive applicator 62 is located at a lower level than the insole rest 14.

Figure 4:
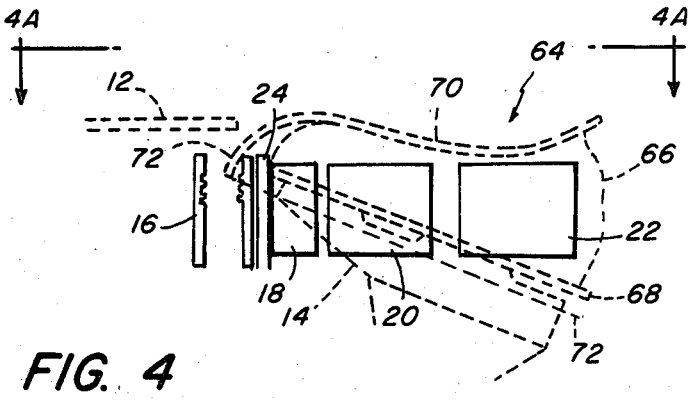
FIG. 4 is a schematic representation of the shoe assembly as it appears in the machine at the beginning of the machine cycle.
Figure 4A:
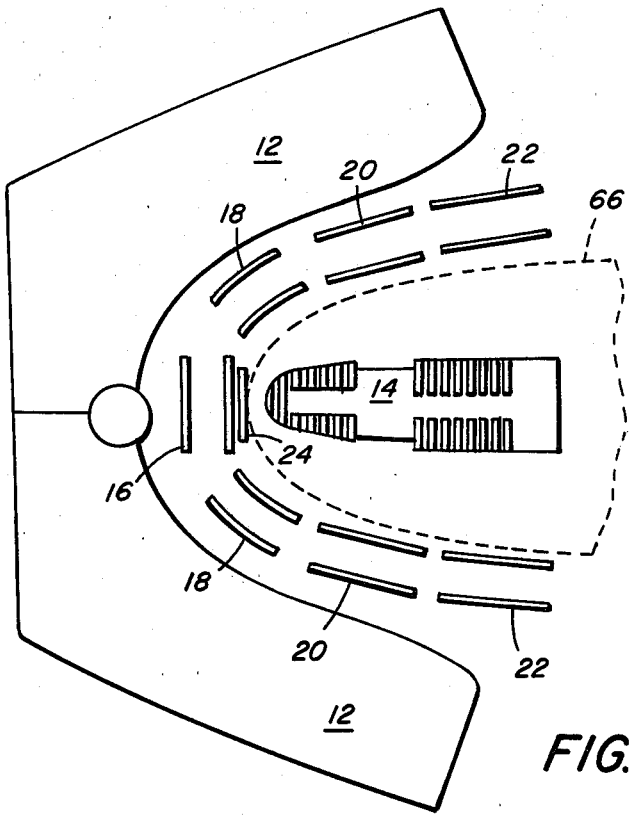
FIG. 4A is a plan view taken along the line 4A—4A of FIG. 4.

Referring to FIG. 4, the wipers 12 are shown in phantom in a retracted position from which they are movable forwardly and inwardly in a horizontal plane in a wiping stroke in a conventional manner such as that shown in U.S. Pat. No. 3,157,897. A shoe assembly 64, formed of a last 66, an insole 68 located on the last bottom and attached to the last bottom by fastening members such as tacks, and an upper 70 draped about the toe, forepart and ball areas of the last, is now presented to the machine bottom-down with insole 68 bearing against the top of the insole rest 14, the toe end extremity of the last bearing against the toe bar 24 and the margin of 72 of the upper 70 extending between the jaws of the pincers 16, 18, 20 and 22. At this time, the bottom of the shoe assembly, by bearing against the top of the insole rest 14 is inclined upwardly and rearwardly with the wipers 12 located rearwardly and outwardly of the shoe assembly 64 (see FIG. 4A).

The jaws of the pincers 16 are now closed on the upper margin 72 after which the jaws of the pincers 18, 20 and 22 are closed on the upper margin whereby the upper margin 72 is gripped by the jaws of all of the pincers 16, 18, 20 and 22. Now there are simultaneous actuations of the motor 36 to raise the piston 40 and of the motor 38 to raise the piston 52. The use of the piston 40, through the piston rod 42 and the plate 44, causes the upright 46 to rise. The rise of the piston 52, through the piston rod 54, the plate 30 and the link 28 causes the bracket 26 to rise. The risings of the upright 46 and the bracket 26 causes the insole rest 14 to rise. When the piston rod 40 can no longer rise, the piston rod 52 continues to rise due to its having a greater range of heightwise movement than the piston 40. This continued rise of the piston 52 causes the pins 50 to move upwardly in the slots 48 to thereby swing the insole rest 14 counterclockwise (FIG. 2) about the center of curvature of the slots 48, this center of curvature substantially coinciding with the zone of engagement of the toe end extremity of the last 66 with the toe bar 24. At the completion of the rise of the insole rest 14 by the motors 36 and 38, the top of the toe insole rest 14 is substantially level with the tops of the wipers 12 and lies in a plane substantially level with the plane of the tops of the wipers 12 as shown in phantom in FIG. 2. During the rise and swinging of the insole rest 14, the upper 70, whose margin 72 is gripped by the pincers 16, 18, 20, 22, is stretched tightly about the last 66.

The purpose of initially inclining the insole rest upwardly and rearwardly is to enable the upper margin 70 to be readily placed between the open jaws of the pincers 18, 20 and 22. This is particularly helpful with respect to the ball pincers 22 wherein the last 66 is relatively wide and the upper margin 72 tends to be relatively narrow. By having the insole rest swing about the zone of engagement of the toe end of the last 66 with the toe bar 24, there is relatively little shifting of the pincers 18, 20 and 22 with respect to the shoe assembly 64 in the heelto toe lengthwise dimension of the shoe assembly thus minimizing any wrinkling of the upper 70 on the last 66 and any tendency of the insole 68 to be detached from the bottom of the last 66 due to loosening of the tacks attaching the insole 68 to the bottom of the last 66.

Because of the connection of the motor 56 to the piston rod 42, the adhesive applicator 62 rises in unison with the rise of the insole support 14. Now, a heel clamp 73 (FIG. 1) is caused to bear against the heel end of the shoe assembly 64 and a toe hold-down 74 (FIG. 1) is caused to be lowered and brought to bear against the top of the vamp of the shoe assembly 64. At about the same time, a pad 76 (FIG. 1) is caused to clamp the toe, forepart and ball portions of the upper 70 against the last 66 and the wipers 12 are placed in positions of readiness for wiping.

Now, in the manner shown in U.S. Pat. No. 4,227,483, the motor 56 is actuated to cause the piston 58, the piston rod 60 and the applicator 62 to rise and the applicator 62 to bear flushly against the insole 68 after which molten thermoplastic adhesive is extruded from the applicator 62 against the toe, forepart and ball portions of the periphery of the insole 68 and the motor 56 is then actuated to lower the piston 58 and thus lower the applicator 62 away from the insole 68.

The remainder of the sequence of operation of the machine generally follows the sequence disclosed in U.S. Pat. Nos. 3,157,897 and 3,902,211. The wipers 12 are caused to move forwardly and inwardly in a wiping stroke to enable the wipers to wipe the toe, forepart and ball portions of the upper margin 72 against the insole 68 and bond the upper margin to the insole by way of the adhesive that had been applied to the insole by the applicator 62. Prior to the completion of the wiping stroke, the jaws of the pincers 16, 18, 20 and 22 are opened to release the upper margin 72 and the motors 36 and 38 are actuated to lower the insole rest 14 out of the path of the wipers 12. The machine cycle is now complete and the machine parts are now returned to their idle positions so that the shoe assembly 64 may be released from the machine.

There follows a recapitulation of the descriptions of those parts of the machine and their modes of operation that are germane to this invention.

The machine, operable in the shoe assembly 64 formed of the last 66 having the upper 70 draped thereon and the insole 68 located on its bottom, acts to stretch the vamp, comprised of the toe, forepart and ball portions, of the upper about the last and wipe the vamp of the upper margin 72 against the insole. The machine comprises: the insole rest 14 mounted for heightwise movement between a lower position and an upper position; the plurality of pincers 16, 18, 20, 22 extending about the insole rest, each pincers having a pair of jaws movable between open and closed positions; wiping means 12, mounted for forward and inward movement, extending about the insole rest; means, comprised of the motor 36 and the appropriate controls therefor (not shown) for initially maintaining the insole rest in its lower position wherein the top of the insole rest is below the top of the wiping means with the shoe assembly so supported on the insole rest that the toe end of the shoe assembly faces rearwardly; means, such as is shown in U.S. Pat. No. 3,902,211, for initially maintaining all of the pincers jaws in their open positions; means, such as is shown in U.S. Pat. No. 3,902,211, for thereafter causing all of the pincers jaws to move to their closed positions to thereby grip the vamp of the upper margin; means, comprised of the motor 36 and the appropriate controls therefor (not shown), for thereafter effecting rising movement to the insole rest to its upper position wherein the top of the insole rest is substantially at the level of the top of the wiping means to thereby enable the vamp of the upper to be stretched about the vamp of the last; means, which may take the form referred to in U.S. Pat. No. 3,157,897, for thereafter imparting forward and inward movement, in a wiping stroke, to the wiping means to cause the wiping means to wipe the vamp of the upper margin against the insole; and means, such as shown in U.S. Pat. No. 3,902,211, for causing all of the pincers jaws to move to their open positions and release the gripped vamp of the upper margin prior to the completion of the wiping stroke.

In accordance with this invention, the machine set forth in the preceding paragraph is improved by comprising: means, formed by the pins 50 and the slots 48, mounting the insole rest for heightwise swinging movement, about a prone axis that is located rearwardly of the insole rest, between an inclined position wherein the insole rest top is inclined rearwardly and upwardly and a prone position wherein the insole rest top is substantially parallel to the top of the wiping means; means, formed by the motor 38 and the appropriate controls (not shown) therefor, for initially maintaining the insole rest in its inclined position when the insole rest is in its lower position; and means, formed by the motor 38 and the appropriate controls (not shown) therefor, to effect such swinging movement to the insole rest about said axis that the insole rest is in its prone position when the insole rest is in its upper position.

One of the pincers comprises the toe pincers 16 located rearwardly of the insole rest 14. The machine further comprises the toe bar 24 located between the toe pincers and the insole rest against which the toe end of the last 66 bears when the shoe assembly 64 is supported on the insole rest while the insole rest is in its initial lower position. The prone axis substantially coincides with the toe bar. The toe bar is mounted to the front of the toe pincers.

The means for effecting said movements to the insole rest 14 comprises: the upright 46; the bracket 26, secured to the insole rest, mounted to the upright by the slots 48 and the pins 50 for swinging movement about said axis; the motor 36, which is a first motor, so connected to the upright 46 as to effect heightwise movement of the upright in response to actuation of the first motor 36; and the motor 38, which is a second motor, so connected to the bracket 26 as to effect swinging movement of the bracket 26 relative to the upright 46 about said axis in response to actuation of the second motor 38.

I claim:

1. A machine, operable on a shoe assembly formed of a last having an upper draped thereon and an insole located on its bottom, for stretching the vamp of the upper about the last and wiping the vamp of the upper margin against the insole comprising: an insole rest mounted for heightwise movement between a lower position and an upper position; a plurality of pincers extending about the insole rest, each pincers having a pair of jaws movable between open and closed positions; wiping means, mounted for forward and inward movement, extending outwardly about the insole rest; means for initially maintaining the insole rest in its lower position wherein the top of the insole rest is below the top of the wiping means with the shoe assembly so supported on the insole rest that the toe end of the shoe assembly faces rearwardly; means for initially maintaining all of the pincers jaws in their open positions; means for thereafter causing all of the pincers jaws to move to their closed positions to thereby grip the vamp of the upper margin; means for thereafter effecting rising movement to the insole rest to its upper position wherein the top of the insole rest is substantially at the level of the top of the wiping means to thereby enable the vamp of the upper to be stretched about the vamp of the last; means for thereafter imparting forward and inward movement, in a wiping stroke, to the wiping means to cause the wiping means to wipe the vamp of the upper margin against the insole; and means for causing all of the pincers jaws to move to their open positions and release the gripped vamp of the upper margin prior to the completion of the wiping stroke; characterized in that the machine comprises: means mounting the insole rest for heightwise swinging movement, about a prone axis that is located rearwardly of the insole rest, between an inclined position wherein the insole rest top is inclined rearwardly and upwardly and a prone position wherein the insole rest top is substantially parallel to the top of the wiping means; means for initially maintaining the insole rest in its inclined position when the insole rest is in its lower position; and means to effect such swinging movement to the insole rest about said axis that the insole rest is in its prone position when the insole rest is in its upper position.

2. The machine according to claim 1 wherein one of the pincers comprises a toe pincers located rearwardly of the insole rest; further comprising: a toe bar located between the toe pincers and the insole rest against which the toe end of the last bears when the shoe assembly is supported on the insole rest while the insole rest is in its initial lower position; and characterized in that said prone axis substantially coincides with the toe bar.

3. The machine according to claim 2 wherein the toe bar is mounted in the front of the toe pincers.

4. The machine of claim 1, claim 2 or claim 3 wherein the means for effecting said movements to the insole rest comprises: an upright; a bracket, secured to the insole rest, mounted to the upright for swinging movement about said axis; a first motor so connected to the upright as to effect heightwise movement of the upright in response to actuation of the first motor; and a second motor so connected to the bracket as to effect swinging movement of the bracket relative to the upright about said axis in response to actuation of the second motor.

* * * * *